US007826793B2

(12) United States Patent
Hong et al.

(10) Patent No.: US 7,826,793 B2
(45) Date of Patent: Nov. 2, 2010

(54) DIGITAL BROADCAST SYSTEM AND METHOD FOR A MOBILE TERMINAL

(75) Inventors: Jung Pyo Hong, Seoul (KR); Ho Soo Kim, Seoul (KR); Yoon Seong Soh, Seoul (KR)

(73) Assignee: LG Electronics Inc., Seoul (KR)

( * ) Notice: Subject to any disclaimer, the term of this patent is extended or adjusted under 35 U.S.C. 154(b) by 776 days.

(21) Appl. No.: 11/531,984

(22) Filed: Sep. 14, 2006

(65) Prior Publication Data

US 2007/0082607 A1 Apr. 12, 2007

Related U.S. Application Data

(60) Provisional application No. 60/726,002, filed on Oct. 11, 2005.

(51) Int. Cl.
*H04H 7/00* (2006.01)

(52) U.S. Cl. ..... 455/3.06; 340/825.24; 381/2; 381/18

(58) Field of Classification Search ..... 455/3.06
See application file for complete search history.

(56) References Cited

U.S. PATENT DOCUMENTS 5,689,641 A * 11/1997 Ludwig et al. ..... 709/241
5,732,324 A * 3/1998 Rieger, III ..... 455/3.01
6,029,126 A * 2/2000 Malvar ..... 704/204
6,058,362 A * 5/2000 Malvar ..... 704/230
6,094,455 A * 7/2000 Katta ..... 375/240.05
6,115,689 A * 9/2000 Malvar ..... 704/503
6,182,034 B1 * 1/2001 Malvar ..... 704/230
6,240,380 B1 * 5/2001 Malvar ..... 704/204
6,253,165 B1 * 6/2001 Malvar ..... 703/2
6,256,608 B1 * 7/2001 Malvar ..... 704/230
6,404,975 B1 * 6/2002 Bopardikar et al. ..... 386/46
6,490,432 B1 * 12/2002 Wegener et al. ..... 455/3.05
6,687,510 B2 * 2/2004 Esteves et al. ..... 455/522
6,701,524 B1 * 3/2004 Okamura et al. ..... 725/37
6,788,653 B1 * 9/2004 Sakamoto et al. ..... 370/282
6,819,863 B2 * 11/2004 Dagtas et al. ..... 386/46
6,931,198 B1 * 8/2005 Hamada et al. ..... 386/46
6,973,065 B2 * 12/2005 Hayashi et al. ..... 370/335

(Continued)

FOREIGN PATENT DOCUMENTS

CN 1607823 4/2005

(Continued)

*Primary Examiner*—Duc Nguyen
*Assistant Examiner*—Hai V Nguyen
(74) *Attorney, Agent, or Firm*—Lee, Hong, Degerman, Kang & Waimey

(57) ABSTRACT

A mobile communication terminal is provided comprising a receiver for receiving broadcast content over a first broadcast channel; and a controller for controlling reproduction of the broadcast content on a display of the mobile terminal. In response to detecting a first event, the controller receives a first request to delay reproduction of broadcast content in real-time. In response to receiving the first request the controller stores, in a storage medium, first broadcast content received between a time T1 and T2. In response to detecting a second event, the controller reproduces the first broadcast content. The controller stores second broadcast content received after a time T3. After the first broadcast content is reproduced, the controller reproduces the second broadcast content.

33 Claims, 13 Drawing Sheets

U.S. PATENT DOCUMENTS 6,999,752 B2 * 2/2006 Fukaya ..... 455/412.1
7,024,156 B2 * 4/2006 Kawamata et al. ..... 455/3.02
7,113,739 B2 * 9/2006 Kawamata et al. ..... 455/3.02
7,133,837 B1 * 11/2006 Barnes, Jr. ..... 705/26
7,197,557 B1 * 3/2007 Asar et al. ..... 709/224
7,206,598 B2 * 4/2007 Attar et al. ..... 455/522
7,231,556 B2 * 6/2007 Kawahara ..... 714/54
7,366,206 B2 * 4/2008 Lockridge et al. ..... 370/509
7,366,754 B2 * 4/2008 Wetzel et al. ..... 709/203
7,383,301 B2 * 6/2008 Yoshimine et al. ..... 709/203
7,398,009 B2 * 7/2008 Candelore et al. ..... 386/94
7,406,294 B1 * 7/2008 Liu ..... 455/3.06
7,406,570 B2 * 7/2008 Fukunaga et al. ..... 711/147
7,433,579 B2 * 10/2008 Arishima ..... 386/83
7,483,451 B2 * 1/2009 Lockridge et al. ..... 370/509
7,493,289 B2 * 2/2009 Verosub et al. ..... 705/51
7,574,169 B2 * 8/2009 Koh ..... 455/3.06
7,593,620 B2 * 9/2009 Surcouf et al. ..... 386/69
7,599,987 B2 * 10/2009 Kondo et al. ..... 709/203
2002/0025777 A1 * 2/2002 Kawamata et al. ..... 455/3.05
2002/0080286 A1 * 6/2002 Dagtas et al. ..... 348/738
2002/0091991 A1 * 7/2002 Castro ..... 717/106
2002/0097235 A1 * 7/2002 Rosenberg et al. ..... 345/204
2002/0100041 A1 * 7/2002 Rosenberg et al. ..... 725/32
2002/0120925 A1 * 8/2002 Logan ..... 725/9
2002/0129374 A1 * 9/2002 Freeman et al. ..... 725/91
2002/0136286 A1 * 9/2002 Koo ..... 375/225
2002/0152115 A1 * 10/2002 Morita et al. ..... 705/13
2003/0013432 A1 * 1/2003 Fukaya ..... 455/412
2003/0054758 A1 3/2003 Kawamata et al.
2003/0070182 A1 * 4/2003 Pierre et al. ..... 725/135
2003/0078930 A1 * 4/2003 Surcouf et al. ..... 707/10
2003/0081671 A1 * 5/2003 Ishida et al. ..... 375/240
2003/0093364 A1 * 5/2003 Bae et al. ..... 705/37
2003/0093790 A1 * 5/2003 Logan et al. ..... 725/38
2003/0097659 A1 5/2003 Goldman
2003/0122959 A1 * 7/2003 Ishida et al. ..... 348/426.1
2003/0124988 A1 * 7/2003 Bae et al. ..... 455/88
2003/0218997 A1 * 11/2003 Lohtia et al. ..... 370/335
2004/0010729 A1 * 1/2004 Lockridge et al. ..... 713/500
2004/0044473 A1 * 3/2004 Leem ..... 701/211
2004/0049598 A1 * 3/2004 Tucker et al. ..... 709/246
2004/0071211 A1 * 4/2004 Washino ..... 375/240.01
2004/0088739 A1 * 5/2004 Shimoji et al. ..... 725/135
2004/0090994 A1 * 5/2004 Lockridge et al. ..... 370/509
2004/0105505 A1 * 6/2004 Kitamura ..... 375/259
2004/0105532 A1 * 6/2004 Nakano ..... 379/88.22
2004/0148551 A1 * 7/2004 Kawahara ..... 714/48
2004/0157560 A1 * 8/2004 Yamasaki ..... 455/63.1
2004/0171377 A1 9/2004 Engstrom
2004/0177162 A1 * 9/2004 Wetzel et al. ..... 709/248
2004/0181569 A1 * 9/2004 Attar et al. ..... 709/200
2004/0201784 A9 * 10/2004 Dagtas et al. ..... 348/738
2004/0204020 A1 10/2004 Kuramitsu
2004/0221319 A1 * 11/2004 Zenoni ..... 725/132
2004/0226050 A1 * 11/2004 Matsuzaki et al. ..... 725/135
2005/0002349 A1 * 1/2005 Hayashi et al. ..... 370/320
2005/0003808 A1 * 1/2005 Bates et al. ..... 455/414.4
2005/0036458 A1 * 2/2005 Yoon et al. ..... 370/328
2005/0078640 A1 * 4/2005 Kim et al. ..... 370/335
2005/0091693 A1 * 4/2005 Amine et al. ..... 725/100
2005/0140790 A1 * 6/2005 Min et al. ..... 348/207.99
2005/0201296 A1 * 9/2005 Vannithamby et al. ..... 370/241
2005/0213928 A1 * 9/2005 Candelore et al. ..... 386/46
2006/0036742 A1 * 2/2006 Yoshimine et al. ..... 709/227
2006/0156355 A1 * 7/2006 Kawasaki et al. ..... 725/88
2006/0193608 A1 * 8/2006 Kim ..... 386/126
2006/0206618 A1 * 9/2006 Zimmer et al. ..... 709/231
2006/0258289 A1 * 11/2006 Dua ..... 455/41.3
2006/0294558 A1 * 12/2006 Morris et al. ..... 725/89
2007/0030178 A1 * 2/2007 Lee et al. ..... 341/50
2007/0082607 A1 * 4/2007 Hong et al. ..... 455/3.06
2007/0115345 A1 * 5/2007 Koh ..... 348/14.02
2007/0127407 A1 * 6/2007 Attar et al. ..... 370/318
2007/0143800 A1 * 6/2007 Salomons ..... 725/74
2007/0190979 A1 * 8/2007 Hatano ..... 455/414.1
2008/0052739 A1 * 2/2008 Logan ..... 725/25
2008/0092168 A1 * 4/2008 Logan et al. ..... 725/44
2008/0288994 A1 * 11/2008 Thelen et al. ..... 725/116
2008/0292082 A1 * 11/2008 Toda et al. ..... 379/207.02

FOREIGN PATENT DOCUMENTS

EP 1398947 3/2004
EP 1524828 4/2005
JP 2002-359809 12/2002
JP 2002-152648 5/2004
JP 2004-186716 7/2004
JP 2004-193944 7/2004
JP 2004248211 9/2004
JP 2005160829 6/2005
KR 10-2001-0011536 A 2/2001
KR 10-2001-0073710 A 8/2001
KR 10-2004-0090552 A 10/2004
KR 10-2005-0073329 A 7/2005
RU 2236703 9/2004
WO WO 2004/093356 A1 10/2004
WO WO 2005022764 A1 * 3/2005

* cited by examiner

DIGITAL BROADCAST SYSTEM AND METHOD FOR A MOBILE TERMINAL

CROSS REFERENCE TO RELATED APPLICATIONS

Pursuant to 35 U.S.C. §119(e)(1), this application claims the benefit of earlier filing date and right of Provisional Application No. 60/726,002, filed on Oct. 11, 2005, the content of which is hereby incorporated by reference herein in its entirety.

FIELD OF THE INVENTION

The present invention is generally directed to systems and methods for receiving, storing, and reproducing digital broadcast content.

BACKGROUND

Digital broadcast systems that are currently available include ground wave digital television broadcast systems, digital satellite broadcast systems and mobile digital broadcast receiving systems.

FIG. 1 illustrates a digital broadcast receiver based on an MPEG-2 transport stream (TS). Referring to FIG. 1, the digital broadcast receiver comprises a code division multiplexing (CDM) unit 110, a CDM buffer 120, a demultiplexer 130, a demultiplexing buffer 140, a decoder 150, and an audio/video (audio/video) output unit 160.

Digital broadcast signals received in the CDM 110 are temporarily stored in the CDM buffer 120. Digital broadcast data output from the CDM buffer 120 is separated into various broadcast information and audio/video streams at the demultiplexer 130. The separated audio/video streams are stored in the demultiplexing buffer 140. Audio/video data output from the demultiplexing buffer 140 are decoded by the decoder 150 and outputted by the audio/video output unit 160. The audio/video output unit 160 includes a display device and an audio output device.

A variety of mobile broadcast receivers can receive digital broadcast content. Examples of such mobile broadcast systems are digital multimedia broadcast (DMB) terminals, digital video broadcast-handheld (DVB-H) terminals, and media flow terminals. Mobile broadcast receivers are formed by applying a broadcast reception function to personal portable terminals (such as cellular phones, personal digital assistants (PDAs), and terminals for a vehicle).

Some digital broadcast receivers may have storage means located inside or outside the receivers. For example, some digital broadcast receivers store digital broadcast content using a hard disk drive (HDD) as a storage device. Digital broadcast receivers which have storage devices can store digital broadcast content using large capacity storage mediums to reproduce and view the stored digital broadcast when needed.

Therefore, mobile broadcast receivers require a foundation which would allow the mobile broadcast receivers to receive and store digital broadcast in real-time using storage mediums and to reproduce and display the stored digital broadcast.

When mobile broadcast receivers store broadcast data received in real-time and, simultaneously, reproduce and display previously stored broadcast data using an HDD-based storage device, storage space is divided so that audio and/or video data are processed using either several files or one file.

Referring to FIG. 2, a storage space of a recordable storing medium is divided to store files (file 1, file 2, file 3, etc.) by a segment unit. When the storage space is filled with data during a recording process, the oldest data segment is deleted first. If a portion of the storage space that is assigned to an arbitrary file 1 is filled with audio and/or video data, file 1 is closed and another file 2 is opened to store audio and/or video data received afterward.

A noticeable time delay for opening or closing a file is generated when the reproduction and display of previously stored broadcast data simultaneously occurs with the storage of currently received broadcast data. Thus, when the receiving, storing and reproduction processes are simultaneously performed, delay or jitter is generated causing reduction of image quality.

Digital broadcast in an HDD-based storage device process only a single file at a time. Thus, only one file pointer is utilized during a write/read operation of audio/video data in order to both store and reproduce data in real-time. A single pointer is inadequate for the seamless reproduction of broadcast content. Systems and methods are needed that can overcome the above-noted shortcomings.

SUMMARY

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of reproducing broadcast content received by a mobile terminal is provided. The method comprises receiving a first request to delay reproduction of broadcast content in real-time, in response to detecting a first event; storing, in a storage medium, first broadcast content received between a time T1 and T2, in response to receiving the first request; reproducing the first broadcast content in response to detecting a second event; storing second broadcast content received after a time T3 as the first broadcast content is being reproduced; and reproducing the second broadcast content after the first broadcast content is reproduced The method may further comprise deleting the first broadcast content from the storage medium after the first broadcast content is reproduced. The second broadcast content is reproduced after the first broadcast content is deleted from the storage medium. Preferably, T2 is approximately equal to T3.

In one embodiment, the first event occurs in response to a user interacting with an interface unit of the mobile terminal. In another embodiment, the first event occurs in response to the mobile terminal receiving an incoming call. In yet another embodiment the first event occurs in response to the mobile terminal initiating an outgoing call. Thus, the first event can be any communication related event directed to the mobile terminal.

In certain embodiments, the second event occurs in response to the mobile terminal ending a phone call, or in response to a user interacting with an interface unit of the mobile terminal.

In accordance with one aspect of the invention, a method of reproducing broadcast content received by a mobile terminal comprises receiving a first request to delay reproduction of broadcast content in real-time, in response to detecting a first event; storing, in a first region of a storage medium, first broadcast content received between a time T1 and T2, in response to receiving the first request; reproducing the first broadcast content stored in the first region of the storage medium, in response to detecting a second event; and storing, in a second region of the storage medium, second broadcast content received after the time T2.

In one embodiment, the first broadcast content stored in the first region of the storage medium is reproduced simultaneously as the second broadcast content is stored in the second region of the storage medium. Preferably, the method further comprises reproducing the second broadcast content after the first broadcast content is reproduced. The second broadcast content may be received in real-time, but not reproduced in real-time until the first broadcast content stored in the first region of the storage medium is fully reproduced.

In another embodiment, the method further comprises deleting the first broadcast content from the first region of the storage medium after the first broadcast content is reproduced; and reproducing the second broadcast content stored in the second region of the storage medium after a predetermined amount of the first broadcast content is deleted from the first region of the storage medium. In some embodiments, the second broadcast content stored in the second region of the storage medium is reproduced after the first broadcast content is fully deleted from the first region of the storage medium.

The method may further comprise deleting the second broadcast content after the second broadcast content is reproduced, and discontinuing storing the second broadcast content in the second region of the storage medium in response to determining that a predetermined amount of the second broadcast content is deleted from the second region of the storage medium.

In one or more embodiments, the method further comprise discontinuing at a time T3 storing the second broadcast content in the second region in response to determining that the second broadcast content is deleted from the second region of the storage medium; and reproducing in real-time third broadcast content received by the mobile terminal after a time T3.

In accordance with another aspect of the invention, a mobile communication terminal comprises a receiver for receiving broadcast content over a first broadcast channel; a controller for controlling reproduction of the broadcast content on a display of the mobile terminal, wherein in response to detecting a first event, the controller receives a first request to delay reproduction of broadcast content received in real-time, wherein in response to receiving the first request, the controller stores, in a storage medium, first broadcast content received between a time T1 and T2, wherein in response to detecting a second event the controller reproduces the first broadcast content; wherein the controller stores second broadcast content received after a time T3; and wherein after the first broadcast content is reproduced the controller reproduces the second broadcast content. The controller deletes the first broadcast content from the storage medium after the first broadcast content is reproduced. The second broadcast content is reproduced after the first broadcast content is deleted from the storage medium.

In accordance with yet another aspect of the invention, a mobile terminal comprises a logic unit for receiving a first request to delay reproduction of broadcast content in real-time, in response to detecting a first event; a logic unit for storing, in a first region of a storage medium, first broadcast content received between a time T1 and T2, in response to receiving the first request; a logic unit for reproducing the first broadcast content stored in the first region of the storage medium, in response to detecting a second event; and a logic unit for storing, in a second region of the storage medium, second broadcast content received after the time T2, wherein the first broadcast content stored in the first region of the storage medium is reproduced simultaneously as the second broadcast content is stored in the second region of the storage medium.

In one embodiment, the mobile terminal further comprises a logic unit for discontinuing at a time T3 storing the second broadcast content in the second region, in response to determining that the second broadcast content is deleted from the second region of the storage medium; and a logic unit for reproducing third broadcast content received by the mobile terminal after the time T3 in real-time.

These and other embodiments of the present invention will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

Features, elements, and aspects of the invention that are referenced by the same numerals in different figures represent the same, equivalent, or similar features, elements, or aspects in accordance with one or more embodiments of the system.

DETAILED DESCRIPTION OF THE PREFERRED EMBODIMENTS

Reference will now be made in detail to the preferred embodiments of the present invention, examples of which are illustrated in the accompanying drawings. The invention may, however, be embodied in many different forms and should not be construed as being limited to the embodiments set forth herein.

One or more embodiments are disclosed as applicable to a digital broadcast receiver having a digital broadcast storage medium. For example, one or more embodiments are directed to a mobile terminal having a digital broadcast reception function and a storage medium. The mobile terminal may be a mobile terminal having a digital broadcast reception function, for example. One or more exemplary embodiments applicable to a mobile terminal will be described in the following. It is noteworthy, however, that the scope of the invention should not be limited to the exemplary embodiments disclosed here and can apply to any system or method for processing digital broadcast content, such as a general-purpose computer, a set-top box, and other digital recording and reproducing systems.

According to one or more embodiments, digital broadcast content can be viewed by a user either before, after or during a telephone call. Preferably, the user may control the reproduction of digital broadcast content from a predetermined point before or after a telephone call.

The above time shift function provides the user with the option to watch the broadcast content after a telephone call has been completed without missing any portion of the content broadcasted during the phone call. For this purpose, a mobile terminal in accordance with one or more embodiments comprises: a reception part for receiving digital broadcast content; a buffer for data processing; a storage medium for storing broadcast content; a controller for controlling the mobile terminal; a terminal manipulation part (e.g., user interface); a communication part for communication; a demultiplexer for processing broadcast data; a decoder for decoding broadcast data; and an output unit (e.g., a display or audio output device) for outputting decoded broadcast data.

Figure 1:
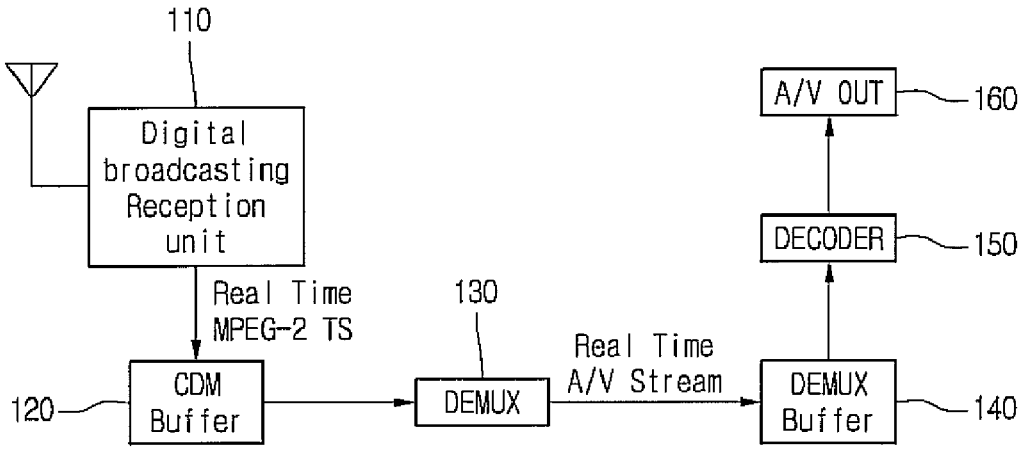
FIG. 1 is a block diagram of a general digital broadcast receiver.
Figure 2:
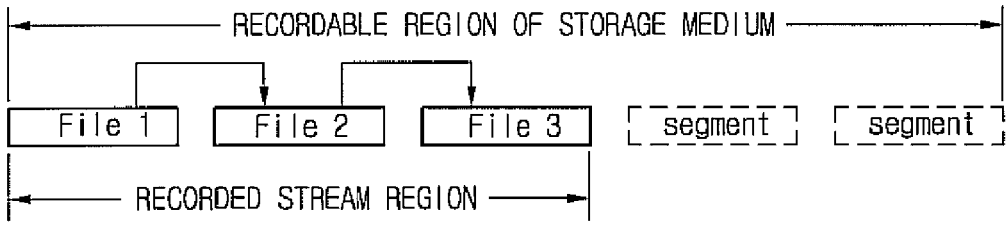
FIG. 2 displays a general method for storing digital broadcast content.
Figure 3:
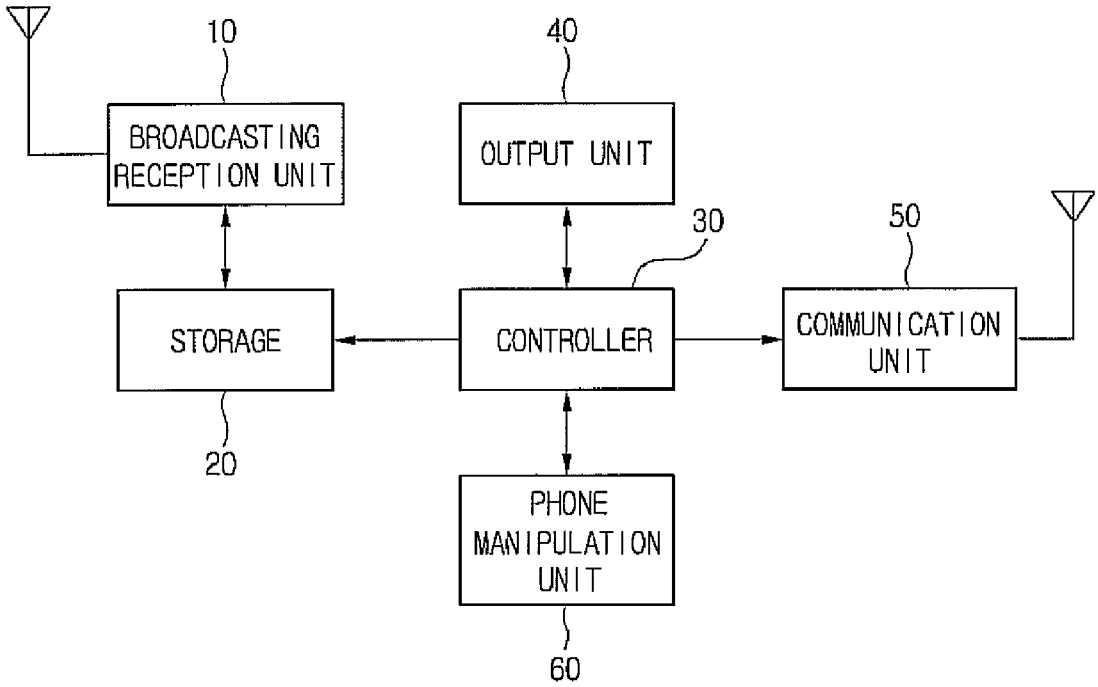
FIG. 3 is a block diagram of an apparatus for processing digital broadcast content in accordance with one embodiment.

FIG. 3 illustrates an exemplary construction of a mobile terminal in accordance with one embodiment. Referring to FIG. 3, the mobile terminal comprises a broadcast reception unit 10, storage 20, a controller 30, an output unit 40, a communication unit 50, and a phone manipulation unit 60.

The broadcast reception unit 10 receives digital audio broadcast or digital audio/video broadcast as controlled by the controller 30. Storage 20 may comprise one or more of a static dynamic random access memories (SDRAMs), flash memories, hard disk drives (HDDs), and optical recoding media. The storage 20 may be built in the mobile terminal or detachably connected to the mobile terminal by way of a data interface. The controller 30 is responsible for broadcast reception, storing, reproducing, outputting, and controlling data communication. The output unit 40 outputs audio/video data. The output unit may comprise a speaker or a headset, and a display device. The communication unit 50 controls voice and/or data communication according to control signals provided by the controller 30. The phone manipulation unit 60 may be a keypad or other user interface unit allowing a user to interact with the mobile terminal.

Figure 4:
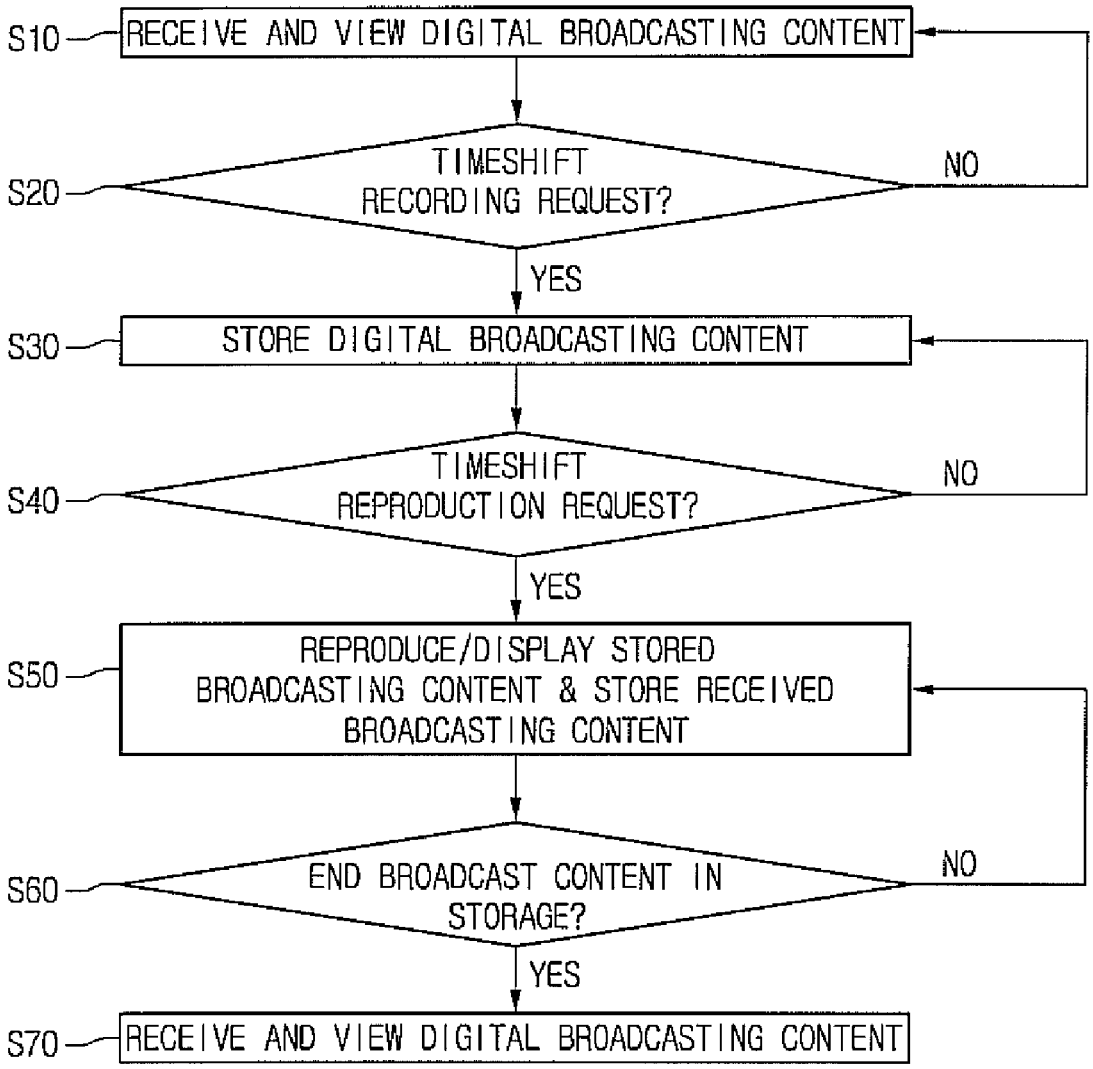
FIG. 4 is a flowchart of a method for processing digital broadcast content in accordance with one embodiment.

FIG. 4 is a flowchart of a method for processing digital broadcast content in accordance with one embodiment. The mobile terminal is configured to receive and display digital broadcast content (S10). A user can, for example, select to receive digital broadcast using the phone manipulation unit 60. The controller 30 recognizes a request for receiving digital broadcast content according to a user interaction with manipulation unit 60. The controller 30 controls the broadcast reception unit 10 to select a channel of digital broadcast, decode signals, and process signals. The broadcast reception unit 10 receives the digital broadcast content over the channel selected by a user, decodes the received digital broadcast content, and processes the related signals. Digital audio/video signals provided by the broadcast reception unit 10 are outputted through the output unit 40, so that the digital broadcast can be viewed by a user.

In one embodiment, the mobile terminal is configured to determine whether a time shift recording request is received (S20). A time shift recording request can be initiated by a variety of events. For example, a user may request a time shift recording using the phone manipulation unit 60 at an arbitrary time before, during or after a phone call is received. That is, a user can perform a time shift recording function at any time. In some embodiments, time shift is performed automatically in response to receiving a telephone call while digital broadcast content is being reproduced or when a telephone call is initiated.

In one embodiment, the mobile terminal preferably stores the digital broadcast content (S30). For example, when a time shift request is received, the broadcast reception unit 10 stores broadcast content received in real-time in the storage 20 (i.e., storage medium).

The mobile terminal then determines whether a time shift reproduction request is received (S40). The time shift reproduction request may be initiated by a variety of events. For example, a user may request time shift reproduction by interacting with the phone manipulation unit 60 at an arbitrary time point. That is, a user can request a time shift reproduction at any time. Or, the time shift reproduction can be automatically performed, for example, after telephone communication is ended.

For example, if a user is viewing broadcast content broadcasted in real-time over a first channel, the user may receive an incoming call or may wish to make an outgoing call. In accordance with one embodiment, at the time T1 when the user either receives the call or initiates the call, a time shift recording request is received by the mobile terminal. When the user completes the call at time T2, a time shift reproduction request is received by the mobile terminal. In the duration of the call (i.e., from T1 to T2) the broadcast content received on the first channel is not displayed on a display screen of the mobile terminal. Nevertheless, the broadcast content is stored in the storage 20. Thus, at time T2 when the voice call is terminated, the mobile terminal reproduces and displays the stored broadcast content and continues to store broadcast content received in real time (S50).

The mobile terminal continues to reproduce and display the broadcast content stored in storage 20, until it is determined that time shift data (i.e., broadcast content received while the user was communicating) stored in storage has been reproduced to the end (S60).

That is, in response to a time shift reproduction request, the controller 30 controls the storage 20 and the broadcast reception unit 10 to store digital broadcast currently received in real-time through the broadcast reception unit 10 in the storage 20, and simultaneously, reproduces and displays digital broadcast previously stored in the storage 20, until the broadcast content stored therein is fully reproduced.

Through the above process, when telephone communication is in progress while digital broadcast is received, a time shift is requested so that audio and/or video data is stored. When the telephone communication is ended, time shift reproduction is requested, so that the storage and display of digital broadcast can be simultaneously performed. Therefore, for example, even when the viewing of digital broadcast is temporarily suspended for telephone communication, digital broadcast corresponding to the suspended period is stored and later reproduced in approximate real-time.

Assuming that time shift recording is requested at an arbitrary first point in time T1 and time shift reproduction is requested at a second point T2 occurring after T1, digital broadcast content received between T1 and T2 is stored in the storage medium. We refer to the digital broadcast data stored in duration from T1 to T2 as first data. We refer to the digital broadcast data stored after time T2 as second data.

Thus, in accordance with one embodiment, when the reproduction and display of the first data is performed, current digital broadcast data is stored as the second data. When the reproduction and display of the first data is completed, the second data is reproduced and displayed. While the second data is reproduced and displayed, current digital broadcast data is being stored since there is a time delay between the broadcast data being received and broadcast data being displayed. As such, digital broadcast content can be viewed continuously but with a time difference denoted by the time lapse from T1 to T2 (S70).

Figure 5:
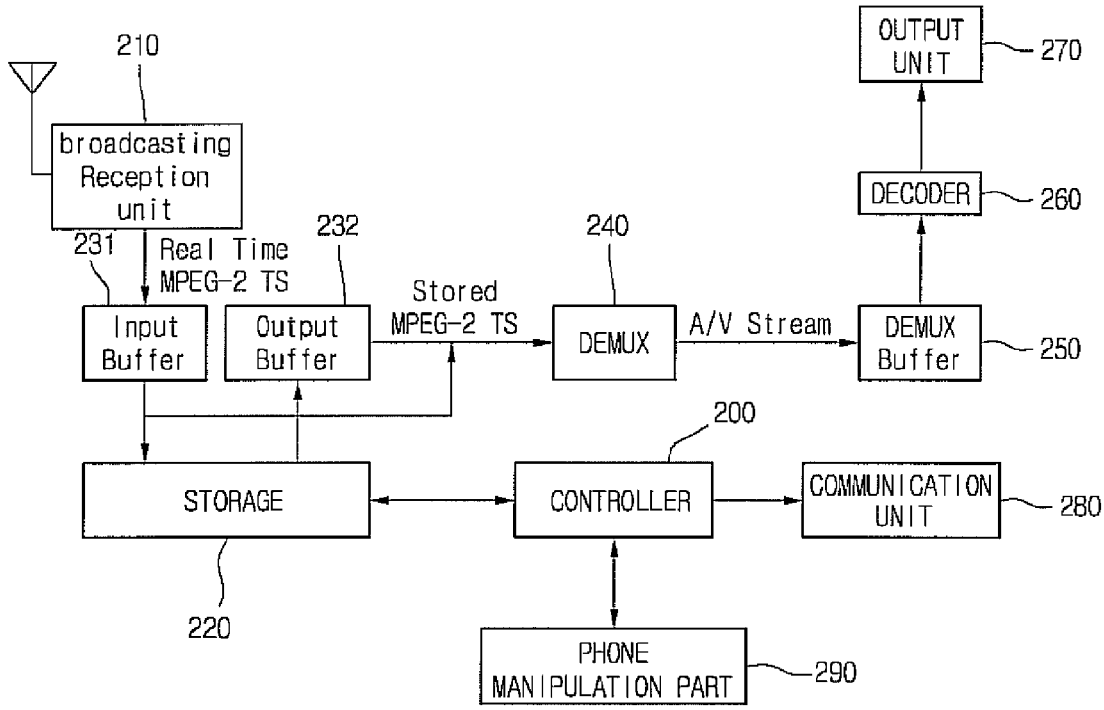
FIG. 5 is a block diagram of an apparatus for processing digital broadcast content in accordance with another embodiment.

FIG. 5 is a block diagram of a mobile terminal in accordance with another embodiment. Referring to FIG. 5, the mobile terminal may comprise a controller 200, a broadcast reception unit 210, a storage 220, an input buffer 231, an output buffer 232, a demultiplexer 240, a demultiplexing buffer 250, a decoder 260, an output unit 270, a communication unit 280, and a phone manipulation unit 290.

The controller 200 is responsible for controlling receiving, storing, reproducing, and displaying broadcast content communicated to the mobile device over a communications network. The broadcast reception unit 210 receives CDM-based digital audio broadcast or digital audio/video broadcast under control of the controller 200.

A variety of storage media may be used to implement the storage 220, examples of which comprise static dynamic random access memories (SDRAMs), flash memories, hard disk drives (HDDs), and optical recoding media. The storage 220 may be built in or detachably mounted on the mobile terminal.

The input buffer 231 buffers digital broadcast signals received by the broadcast reception unit 210, delivers the same to the demultiplexer 240, and stores the buffered broadcast data in the storage 220 when a time shift recording request is received. The input buffer 231 is responsible for a buffering operation for accurately displaying broadcast signals transmitted in real-time.

The output buffer 232 buffers digital broadcast data provided by the storage 220 and delivers the same to the demultiplexer 240 when a time shift reproduction request is made. The output buffer 232 is used as a time shift buffer. The time shift buffer prevents a jitter phenomenon generated when broadcast is displayed as a digital broadcast data file is written and read to and from the storage 220, thereby preventing image quality reduction. That is, since it takes a relatively long time to write and read a file to and from the storage, corresponding data are buffered so that a jitter phenomenon caused by a time delay associated with file reading/writing operations can be prevented.

The demultiplexer 240 receives digital broadcast data buffered by the input buffer 231 or buffered by a time shift buffer (e.g., output buffer 232) and separates the buffered digital broadcast data into various broadcast data and audio/video data. The separated audio/video data are delivered to the demultiplexing buffer 250, for example. The demultiplexing buffer 250 is responsible for buffering in order to accurately display broadcast signals transmitted in real-time like the input buffer 231. Digital broadcast data outputted from the demultiplexing buffer 250 are delivered to the decoder 260.

The decoder 260 decodes audio/video streams so that the audio/video streams can be displayed. The decoded audio/video signals are outputted through the output unit 270. The output unit 270 outputs audio/video data. The output unit 270 may, for example, comprise a speaker or a headset, and a display device. In one embodiment, the communication unit 280 is responsible for voice and/or data communication under control of the controller 200. The phone manipulation unit 290 may be a keypad allowing a user to manipulate a mobile terminal, for example.

The operation of processing digital broadcast signals in a mobile terminal in accordance with one embodiment will be described with reference to FIGS. 4 and 5. When a digital broadcast reception command is received, the controller 200 controls the broadcast reception unit 210 to select a channel desired by a user. Digital broadcast signals of the selected channel are buffered by the input buffer 231, and inputted to the demultiplexer 240. The digital broadcast signals inputted to the demultiplexer 240 can be separated into various broadcast data and audio/video streams, for example. The audio/video streams are buffered by the demultiplexing buffer 250 and delivered to the decoder 260. The decoder 260 decodes audio/video streams, and the output unit 270 outputs audio and video signals.

As described above, when a time shift recording request is made through the phone manipulation unit 290 by a user or when a telephone call is received or a communication event for making a phone call occurs, the controller 200 starts time shift recording. When the time shift recording starts, the storage 220 stores digital broadcast data buffered by the input buffer 231 under the control of the controller 200. In one embodiment, the digital broadcast data stored in the storage 220 is stored in a file. The controller 200 recognizes a storage position of digital broadcast data. Also, the controller 200 recognizes a reproduction position when a file of digital broadcast data is reproduced.

Preferably, when a time shift reproduction request is received, or when a telephone communication event is ended, the controller 200 starts time shift reproduction. As the time shift reproduction starts, a broadcast data file that has been stored in the storage 220 is buffered by the output buffer 232 (e.g., the time shift buffer) under the control of the controller 200, and delivered to the demultiplexer 240. Simultaneously, digital broadcast signals received from a time shift reproduction point are buffered by the input buffer 231 and stored in the storage 220.

The demultiplexer 240 demultiplexes digital broadcast data reproduced through the output buffer 232 and outputs the demultiplexed data to the output unit 270 via the demultiplexer buffer 250 and the decoder 260. Therefore, digital broadcast signals stored from a time shift recording request point (T1) to a time shift reproduction request point (T2) are outputted through a display device or an audio output device, for example. Also, simultaneously, digital broadcast signals received from the time shift reproduction request point are stored in the storage 220. The digital broadcast signals stored in this manner are subsequently reproduced when the reproduction of the previously stored file containing the digital broadcast data is completed, for example.

In one embodiment, when the stored file containing the digital broadcast data is reproduced and displayed, a user can search for a reproduction position using the phone manipulation unit 290. This is performed on the basis of information regarding a position of digital broadcast data recorded or currently reproduced. For example, when a user inputs a command such as "fast-forward", "rewind" or "pause" through the phone manipulation unit 290, the controller 200 performs a movement to a reproduction point desired by a user. The reproduction point is a pointer to a location in the storage 220 based on the information regarding the position of the digital broadcast data using the phone manipulation unit 290, and performs a reproduction operation from the moved point. In the case of "pause," reproduction is suspended and a video frame at this point is reproduced and displayed, for example.

In another embodiment, when a time shift reproduction end request is received, the controller 200 ends time shift reproduction. When the time shift reproduction end request is inputted, storage of digital broadcast is stopped and a corresponding file is deleted if necessary. The currently received digital broadcast data is then decoded and displayed.

Figure 6:
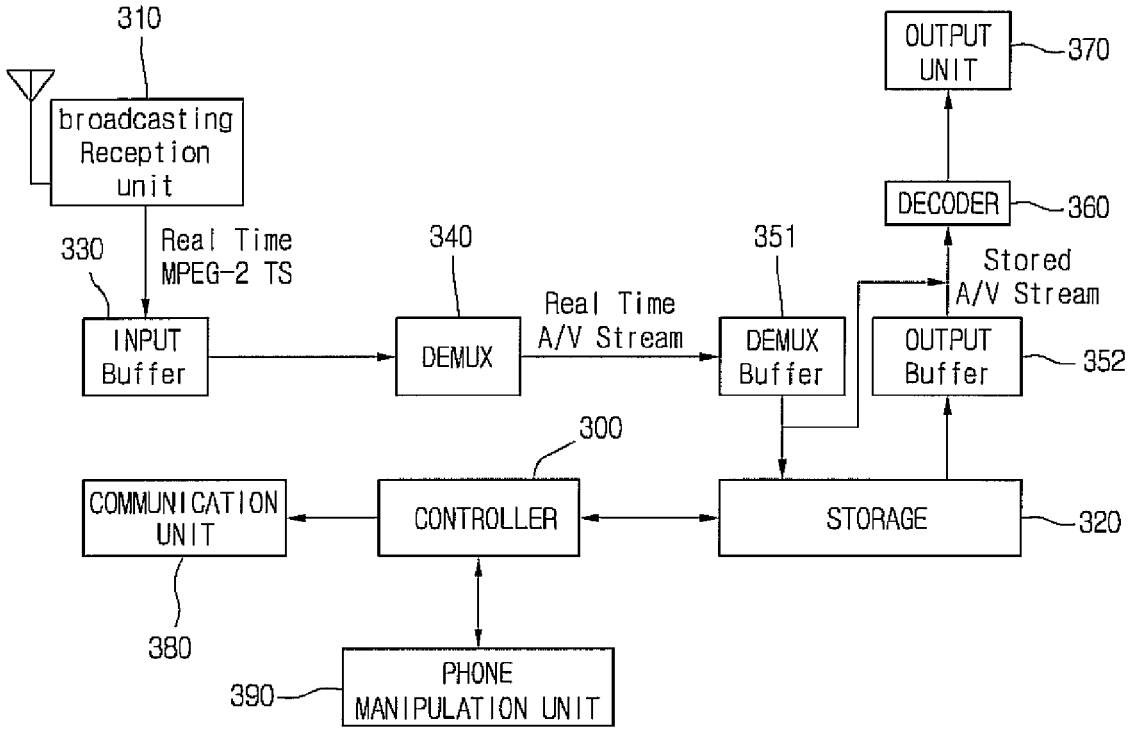
FIG. 6 is a block diagram of an apparatus for processing digital broadcast content in accordance with another embodiment.

FIG. 6 is a block diagram of a mobile terminal comprising an apparatus for processing digital broadcast in accordance with another embodiment. Referring to FIG. 6, the mobile terminal comprises a controller 300, a broadcast reception unit 310, a storage 320, an input buffer 330, an output buffer 352, a demultiplexer 340, a demultiplexing buffer 351, a decoder 360, an output unit 370, a communication unit 380, and a phone manipulation unit 390.

The controller 300 is responsible for broadcast reception, storing and reproducing, outputting, and communication control, for example. The broadcast reception unit 310 receives CDM-based digital audio broadcast or digital audio/video broadcast content, for example, under the control of the controller 300. The input buffer 330 is, for example, a CDM buffer which buffers digital broadcast signals received by the broadcast reception unit 310, delivers the buffered signals to the demultiplexer 340, and is responsible for a buffering process in order to accurately display broadcast signals transmitted in real-time.

The demultiplexer 340 receives digital broadcast data buffered by the input buffer 330 and separates the buffered digital broadcast data into various broadcast data and audio/video data, for example. The separated audio/video data are delivered to the demultiplexing buffer 351. The demultiplexing buffer 351 is responsible for buffering in order to accurately display broadcast signals transmitted in real-time like the input buffer 330, for example. Digital broadcast data output from the demultiplexing buffer 351 are delivered to the decoder 360 and also to the storage 320 for the purpose of time shift recording.

A variety of storage media may be used for the storage 320, examples of which comprise static dynamic random access memories (SDRAMs), flash memories, hard disk drives (HDDs), and optical recoding media. The storage 320 may be built in an apparatus or detachably mounted from the outside on the basis of an interface, for example. In one embodiment, the storage 320 stores audio/video streams. The output buffer 352 buffers digital broadcast data output from the storage 320 and delivers the buffered data to the decoder 360 when a time shift reproduction request is received, for example.

The output buffer 352 is used as a time shift buffer, in accordance with one embodiment. The output buffer 352 prevents a jitter phenomenon generated when broadcast content is displayed as a digital broadcast data file stored in the storage 320, thereby preventing image quality reduction. That is, since it takes a relatively long time to write and read a file to and from the storage 320, corresponding data are buffered, so that a jitter phenomenon caused by a file reading/writing time delay can be prevented.

The decoder 360 decodes audio/video streams so that the audio/video streams can be displayed. Decoded audio/video signals are outputted through the output unit 370. The output unit 370 outputs audio and/or video. The output unit 370 comprises a speaker or a headset, and a display device, for example. The communication unit 380 is responsible for voice and/or data communication under the control of the controller 300. The phone manipulation unit 390 may be a keypad allowing a user to manipulate a mobile terminal, for example.

Referring to FIG. 6, a digital broadcast reception command can be inputted through the phone manipulation unit 390, by a user. Upon receipt of the broadcast reception command the controller 300 controls the broadcast reception unit 310 to select a channel desired by a user. Digital broadcast signals of the selected channel are buffered by the input buffer 330 and inputted to the demultiplexer 340. The digital broadcast signals inputted to the demultiplexer 340 are separated into various broadcast data and audio/video streams, for example.

The audio/video streams are buffered by the demultiplexing buffer 351 and delivered to the decoder 360. The decoder 360 decodes audio/video streams, and the output unit 370 outputs audio and video signals. As provided above, when a time shift recording request is made through the phone manipulation unit 390 by a user or when a telephone call is received or attempted, the controller 300 starts time shift recording.

When the time shift recording starts, the storage 320 stores digital broadcast data buffered by the demultiplexing buffer 351 under the control of the controller 300. In certain embodiments, the digital broadcast data stored in the storage 320 are stored in a file, for example. The controller 300 recognizes a storage position of digital broadcast data. Also, the controller 300 recognizes a reproduction position when a file of digital broadcast data is reproduced, for example.

Preferably, when a time shift reproduction request is received, or when a telephone communication event (e.g., a phone call) is ended, the controller 300 starts time shift reproduction. As the time shift reproduction starts, a broadcast data file that has been stored in the storage 320 is buffered by the output buffer 352 (time shift buffer) under the control of the controller 300, and delivered to the decoder 360. Simultaneously, digital broadcast signals received from a time shift reproduction point are buffered by the demultiplexing buffer 351 and stored in the storage 320.

In one embodiment, digital broadcast signals stored from a time shift recording request point (T1) to a time shift reproduction request point (T2) are outputted through a display device and an audio output device, for example. Preferably, digital broadcast signals received from the time shift reproduction request point are stored in the storage 320. The digital broadcast signals stored in this manner are subsequently reproduced when the reproduction of the previously stored file containing the digital broadcast data is completed.

In another embodiment, when the stored file containing the digital broadcast data is reproduced and displayed, a user can search for a reproduction position using the phone manipulation unit 390. This is performed on the basis of information regarding a position of digital broadcast data recorded or currently reproduced. For example, when a user inputs a search command such as "fast-forward," "rewind" or "pause," the controller 300 moves to a point in a reproduction point desired by a user and performs a reproduction operation from that point. In the case of "pause," reproduction is suspended and a video frame is reproduced and displayed.

When a time shift reproduction end request is received, the controller 300 preferably ends time shift reproduction. When the time shift reproduction end request is inputted, storage of digital broadcast is stopped and, in some embodiments, a corresponding file is deleted. The decoding and displaying of the currently received digital broadcast data are performed thereafter.

In the above-described embodiments, the controller can determine information about the position of a region of the storage that is recordable for a time shift operation. For example, when a semiconductor memory is used, a starting position and an end position of a recordable region is known, and a starting position and an end position of a recorded region with respect to the recordable region is attainable by using a memory pointer. Also, when reproduction is performed, a current reproduction position can be determined, and when recording is performed, a current recording position can be determined.

As described above, digital broadcast can be stored either automatically, by a user's request, or based on a predetermined setting while the digital broadcast is viewed. When a reproduction and a display request are received, the previously stored broadcast data is reproduced and displayed, and preferably simultaneously, real-time broadcast data in is stored as it is received. Storage space can be efficiently controlled by deleting the reproduced broadcast content from storage.

Figure 7:
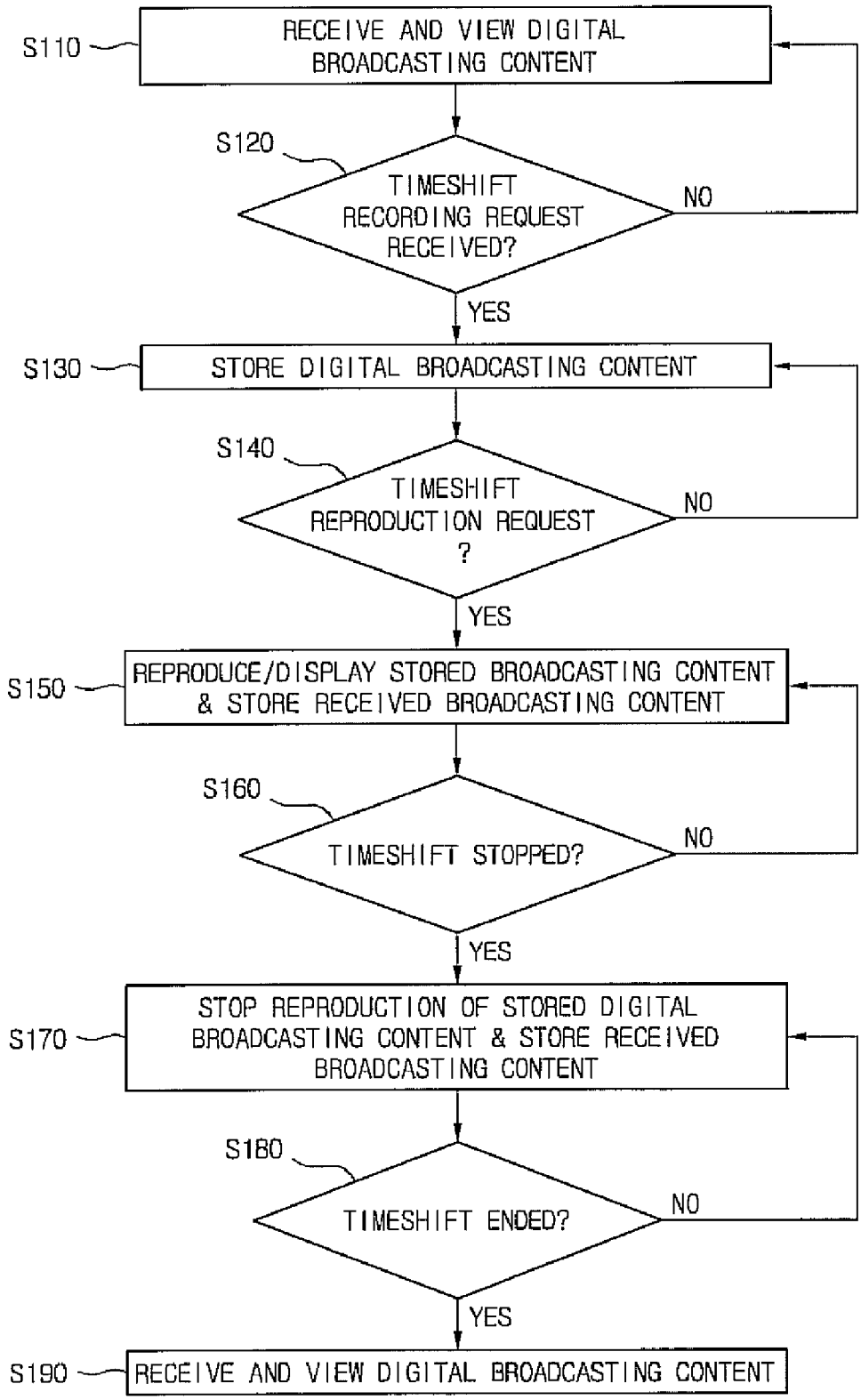
FIG. 7 is a flowchart of a method for processing digital broadcast content in accordance with another embodiment.

Referring to FIGS. 6 and 7, the mobile terminal is configured to received and display digital broadcast content (S110). A user can select to receive digital broadcast content using the phone manipulation unit 390. The controller 300 recognizes reception of digital broadcast content and controls the broadcast reception unit 310 to select a channel of digital broadcast, decode signals, and process signals. The broadcast reception unit 310 receives the digital broadcast of the channel selected by a user, decodes the received digital broadcast, and processes signals. Digital audio/video signals outputted from the broadcast reception unit 310 are outputted through the output unit 370, so that the digital broadcast is viewable by the user.

It is then determined whether a time shift recording request is received (S120). A time shift recording request may for example be initiated by a user, when a telephone call is received, or when a telephone call is made. When a time shift recording is received, the broadcast reception unit 310 stores broadcast content in the storage 320, real-time in (S130). It is determine if a time shift reproduction request is received (S140).

The time shift reproduction request may be received either as a result of the user manually interacting with the device, or can be automatically initiated, for example, when a telephone call ends. When a time shift reproduction request is received, digital broadcast content received in real-time is stored in the storage 320, and in one embodiment, previously stored digital broadcast content is simultaneously reproduced and displayed as newly broadcasted content is being stored (S150).

When a time shift reproduction request is made, the controller 300 controls the storage 320 and the broadcast reception unit 310 to store digital broadcast received in real-time through the broadcast reception unit 310 in the storage 320. In one embodiment, digital broadcast previously stored in the storage 320 is reproduced and displayed from the time shift starting point.

It is then determined whether a time shift reproduction stop request is received (S160). For example, a user may request a time shift reproduction stop at an arbitrary time point. If when a time shift stop request is received, the reproduction and display of previously stored digital broadcast is stopped, and digital broadcast currently received in real-time is stored in the storage 320 (S170). That is, when the time shift stop request is received, the broadcast content is no longer displayed, and preferably the received digital broadcast content is stored.

It is then determined whether a time shift end request is received (S180). For example, a user may request a time shift end if the user wishes to view the digital broadcast content as it is received in real-time instead of viewing the content stored in the storage 320 with a time delay.

In one embodiment, when a time shift end request is received, previously stored digital broadcast data are deleted, and digital broadcast content that is received in real time is outputted displayed. According to the above-described process, when a telephone call is initiated during display of digital broadcast, a time shift request is received by the mobile terminal so that audio/video data are stored for the duration of the call. When the call ends, a time shift reproduction is requested so that the storage and display of digital broadcast are simultaneously performed. Therefore, even when the viewing of digital broadcast is temporarily suspended during a telephone call, digital broadcast corresponding to the suspended period is stored and can be subsequently viewed in approximate real-time.

Figure 8:
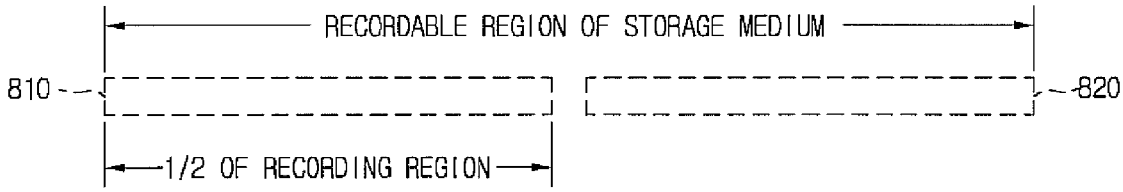
FIG. 8 illustrates an example of a division of a storage space in accordance with one embodiment.

The time shift function can be efficiently performed using a preferably small capacity storage medium, for example. In accordance with one embodiment, an efficient digital broadcast process is performed on the basis of file switching. Referring to FIG. 8, the file switching may be performed by way of dividing a storage medium into a plurality of regions.

In one embodiment, a recordable region of the storage medium is divided into two regions, such that one of the two divided regions is used for recording and the other is used for reproducing recorded data, for example. Referring to FIG. 8, the recordable region of the storage medium is divided into a first region 810 and a second region 820. When either one of the first and second regions 810 or 820 is used for a recording region, the other is used for a reproduction region. When a file is reproduced, the first and second regions 810 and 820 are respectively responsible for recording and reproducing.

The recordable region of the storage medium for a time shift may be set to a fixed size in advance, or the controller can preferably set the recordable region adaptively and depending on the remaining storage capacity. Also, a fixed maximum size may be set or the recordable region of the storage medium may be set adaptively and variably depending on a current remaining capacity of the storage medium.

In the above-described embodiments, the controller is configured to determine information regarding a position on the storage region that is recordable for a time shift operation. For example, when a semiconductor memory is used, a starting position and an end position of a recordable region are determined based on the position of a memory pointer. When reproduction is performed, a current reproduction position is determined, and when recording is performed, a current recording position is determined.

Figure 9:
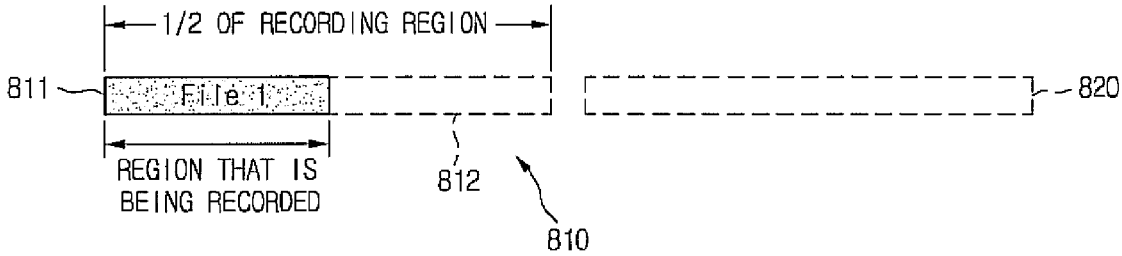
FIG. 9 illustrates an example of a method for using a storage space when digital broadcast content is stored in accordance with one embodiment.

FIG. 9 illustrates a method for using the first region 810 and the second region 820 when a time shift start request is received. When a time shift start request is received, a file is created and opened in a write mode, and received broadcast data are stored as illustrated in FIG. 5. When the method is based on the division of the storage space described with reference to FIG. 8, recording is performed using a file 1 contained in the first region 810. Accordingly, the first region 810 has a region 811 one which data is recorded and a remaining region 812 that can be used for future recording.

Figure 10:
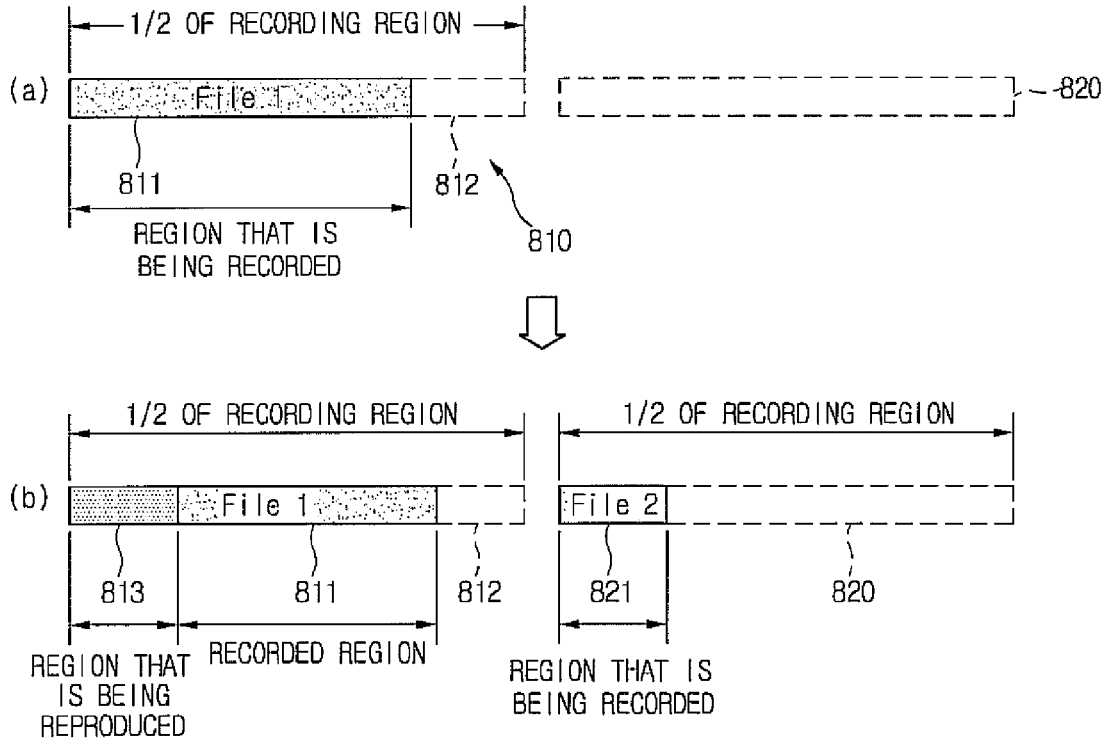
FIG. 10 illustrates an example of a method for using a storage space when digital broadcast content is reproduced in accordance with one embodiment.

FIG. 10 illustrates a method for using the first region 810 and the second region 820 when a time shift reproduction request is received. When a time shift reproduction request is received, a mode of the file 1 is changed from recording mode into a read mode, so that previously recorded broadcast data is reproduced and displayed. Preferably, broadcast data that is received in real-time is stored in a file 2 in the second region 820 in a write mode, and the broadcast data that is being received is recorded in the file 2. The naming convention use here, referring to file 1 and file 2 is by way of example and should not be used to limit the scope of the invention to the particular exemplary embodiments disclosed.

Referring to FIG. 10(*a*), when a time shift reproduction request is received, the first region 810 comprises a region 811 on which recording is performed and a remaining region 812. Referring to FIG. 10(*b*), when a time shift reproduction request is made, reproduction is performed on the first region 810, and real-time broadcast data received from this point of the time shift reproduction request are recorded in the second region 820. When the reproduction is performed on the first region 810, the first region 810 has both a region 813 that is being reproduced and a recorded region 811, and the second region 820 has a region 821 on which recording is performed using a file 2 of the region 821.

Figure 11:
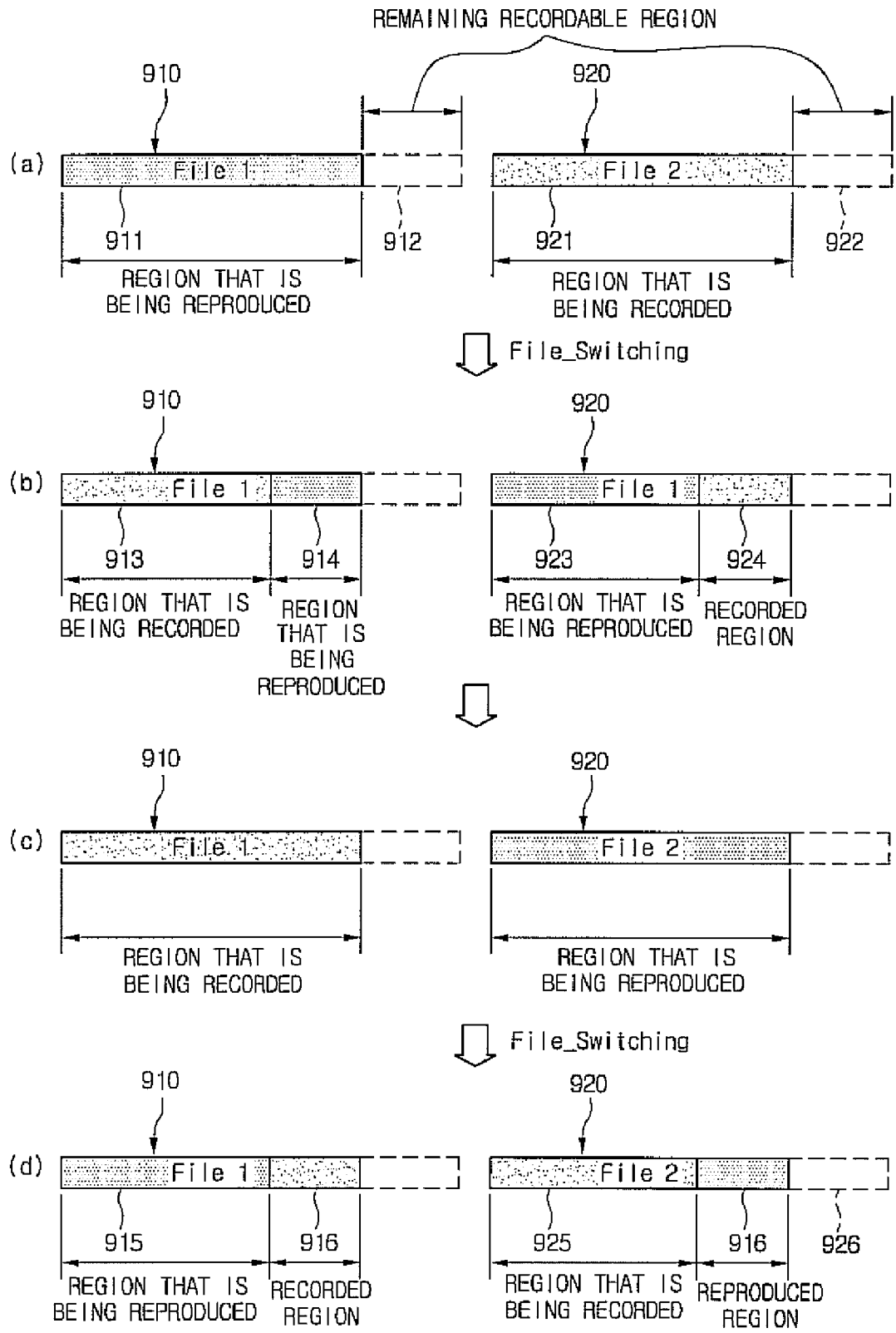
FIG. 11 illustrates an example of a method for using a storage space during reproduction of digital broadcast content in accordance with one embodiment.

FIG. 11 illustrates a file switching process which occurs during time shift reproduction, in accordance with one embodiment. As described previously with reference to FIG. 10, while previously recorded broadcast data is reproduced and displayed, broadcast data that is currently received in is recorded. The mode of the file 1 is changed from a read mode to a write mode at a reproduction completion point, and the mode of the recorded file 2 is changed into a read mode, so that the file 2 is reproduced and displayed and the currently received broadcast data is recorded using the file 1.

Such a file switching operation is preferably performed until time shift reproduction is competed. In one embodiment, when reproduction of a file contained in the first region 910 is completed, a recorded file contained in the second region 920 is reproduced. Preferably, the received broadcast data is recorded in the first region 910. When reproduction of the recorded file contained in the second region 920 is completed, the recorded file contained in the first region 910 is reproduced. Preferably, the received broadcast data is recorded in the second region 920.

FIG. 11(*a*) illustrates that when a file 1 contained in the first region 910 is reproduced, the first region 910 has a region 911 being reproduced and a remaining recordable region 912. When a file 2 contained in the second region 920 is recorded, the second region 920 has both a region 921 that is being recorded and a remaining recordable region 922. Preferably, when the file 1 of the first region 910 is reproduced and a recorded region does not exist any more, file switching between the first region 910 and the second region 920 is performed as illustrated in FIG. 11(*b*).

Accordingly, when a file 1 contained in the first region 910 is recorded, the first region 910 comprises a region 913 that is being recorded and a region that is being reproduced 914. Also, when a file 2 contained in the second region 920 is reproduced, the second region 920 has both a region 923 that is being reproduced and a previously recorded region 924.

FIG. 11(*c*) illustrates that that when a file 2 contained in the second region 920 is reproduced, the second region 920 comprises a region that is being reproduced and a remaining recordable region. In one embodiment, when a file 1 contained in the first region 910 is recorded, the first region 910 has both a region that is being recorded and a remaining recordable region. Here, when the file 2 of the second region 920 is reproduced and a recorded region does not exist any more, file switching between the first region 910 and the second region 920 is performed as illustrated in FIG. 11D.

Accordingly, referring to FIG. 11D, when a file 1 contained in The first region 910 is reproduced, the first region 910 has both a region 915 that is being reproduced and a previously recorded region 916. When a file 2 contained in the second region 920 is recorded, the second region 920 comprises a region 925 that is being recorded and a previously reproduced region 926.

The above-described file switching is constantly performed during time shift reproduction as described above. When a time shift stop request is made during a reproduction/display operation and a simultaneous recording operation, a file that belongs to a region that is being reproduced is closed, and broadcast data recording in the other region is constantly performed. Preferably, when a time shift end request is received, even a file that belongs to a region that is being recorded is closed, and a file that has been used for time shift (e.g., file 1 and file 2) is deleted. The deletion of the files allows for the storage space of the storage medium to be used for other purposes.

As described above, digital broadcast is stored automatically, by a user's request or by a setting, while the digital broadcast is displayed. When a reproduction and display request is received, the previously stored broadcast data is reproduced and displayed. The storage and reproduction of broadcast data are performed on the basis of the file switching to optimize data storage space.

Since a time shift method in accordance to one embodiment is based on recording/reproducing for a short period of time, and opening/closing of a file does not occur during a time shift operation, jitter and delay phenomenon caused by the opening/closing of the file are prevented, so that a limited storage capacity can be efficiently used.

Figure 12:
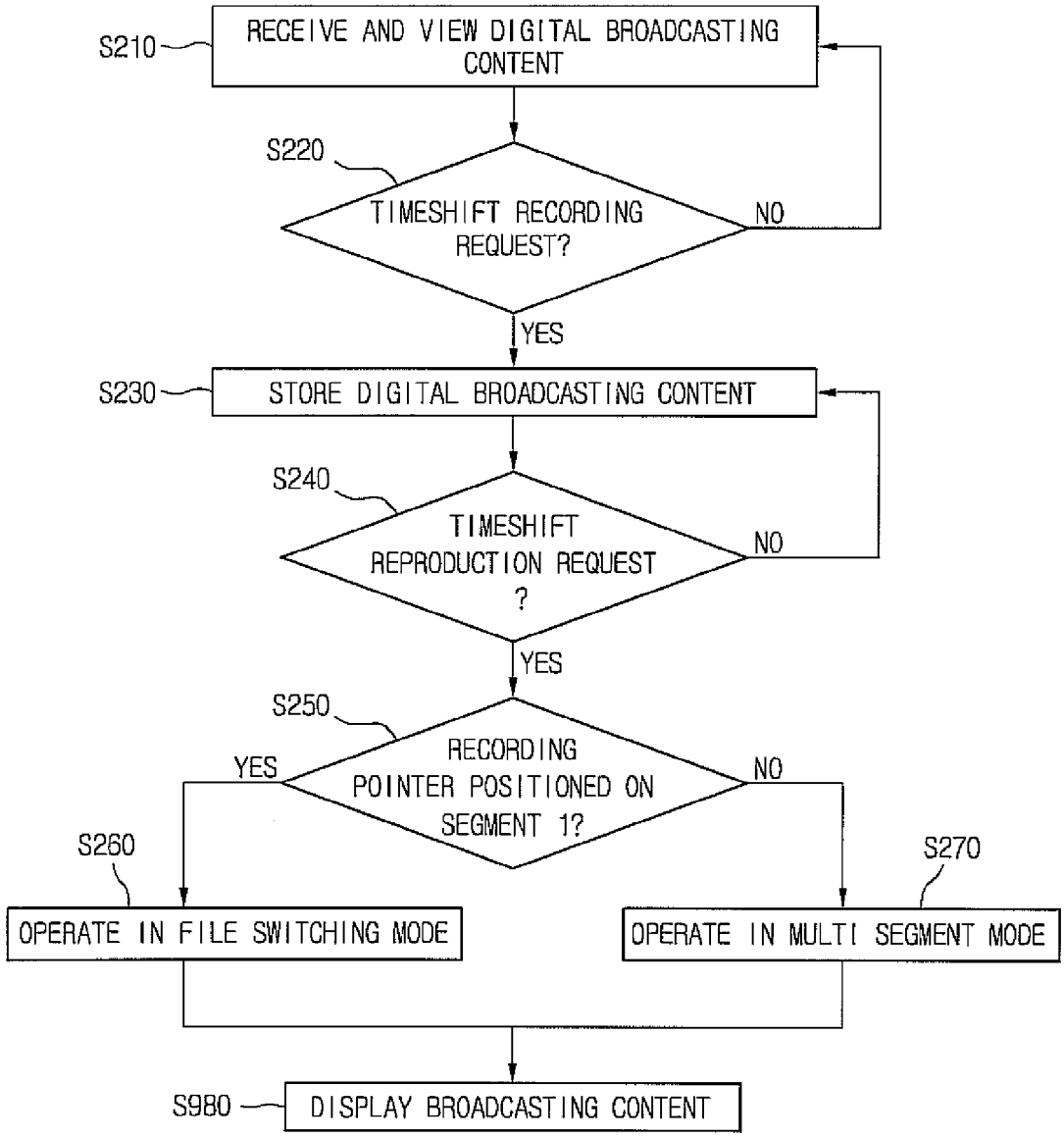
FIG. 12 is a flowchart of a method for processing digital broadcast content in accordance with one embodiment.

FIG. 12 is a flowchart of a method for processing digital broadcast content in accordance with one embodiment. The method for processing the digital broadcast in accordance with one embodiment will be described with reference to FIG. 12.

In one embodiment, a mobile terminal is configured to receive and display digital broadcast content (S210). A user can select to receive digital broadcast content using a user interface of the mobile terminal. The mobile terminal is configured to determine whether a time shift recording request is received (S220). If so, the mobile terminal stores digital broadcast content in memory (S230). The mobile terminal determines whether a time shift reproduction request is received (S240).

When a time shift reproduction request is received, a current position of a write pointer is determined. A file switching mode or multi segment mode is performed depending on the position of the write pointer. In accordance with one or more embodiments, time shift recording and time shift reproduction are performed by utilizing a variable portion of the memory storage space.

In one embodiment, the mobile terminal determines whether a write pointer position is pointing to a first region (e.g., segment 1) (S250). If the write pointer is located in the first region, the file switching mode is activated (S260), otherwise, the multi segment mode is activated (S270).

When a time shift reproduction request is received and either one of the file switching mode or the multi segment mode is active, digital broadcast content is stored in the memory. Preferably, the previously stored digital broadcast content is reproduced and displayed. When the time shift reproduction request is received, the digital broadcast content currently received is stored in memory and the stored content is reproduced and displayed (S280).

Through the above-described process, when a telephone call is connected and while digital broadcast content is viewed, a time shift request is made so that audio/video data is stored in memory. When the communication is completed, a time shift reproduction is requested so that the storage and display of digital broadcast are simultaneously performed. Therefore, even when the viewing of digital broadcast is temporarily suspended for telephone communication, digital broadcast corresponding to the suspended period is stored and subsequently viewed in approximate real-time, for example.

In accordance with one embodiment, an efficient digital broadcast process is performed on the basis of the file switching mode and/or the multi segment mode. In one embodiment, a recordable region of a storage medium is divided into a plurality of regions. For example, referring to FIG. 13, the recordable region of the storage medium is divided by a segment unit. Therefore, a first storage region corresponds to a first segment, a second storage region corresponds to a second segment, and an Nth storage region corresponds to an Nth segment.

Figure 13:
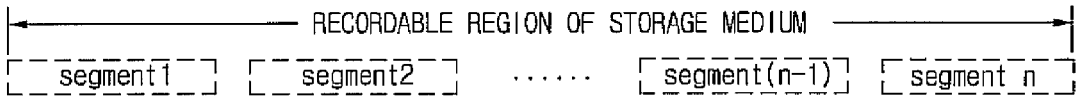
FIG. 13 illustrates an example of a division of a storage space in accordance with one embodiment.

FIG. 13 illustrates an example of dividing the recordable region of the storage medium into a plurality of segments. In one or more embodiments, the file switching mode refers to the recording or reproduction of digital broadcast data using two or more storage regions.

Figure 14:
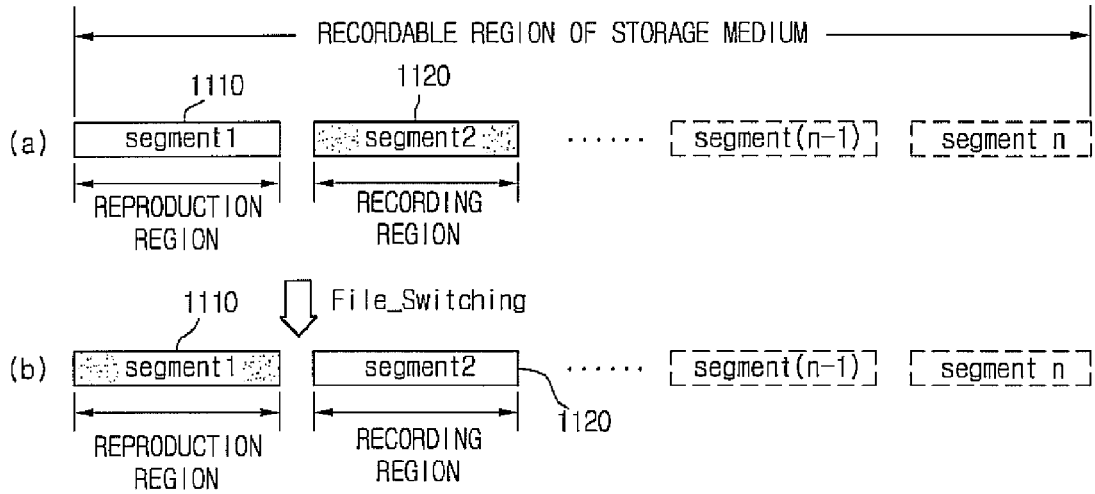
FIG. 14 illustrates a file switching mode when digital broadcast content is reproduced in accordance with one embodiment.

In one embodiment, the file switching is based on a method of dividing a storage medium into a plurality of regions as illustrated in FIG. 14. A first region 1110 and a second region 1120 of a recordable region of the storage medium are illustrated. In one embodiment, when a time shift recording request is received, digital broadcast data is recorded. When a write pointer is positioned on the first region 1110 (segment 1) at a reproduction request point, digital broadcast data previously stored in the segment 1 is reproduced and displayed, and simultaneously, digital broadcast data received from this point is recorded in the second region 1120 (segment 2) in real-time.

In another embodiment, when reproduction of the digital broadcast data stored in the segment 1 is completed, digital broadcast data is stored in the segment 2, and is reproduced and displayed, at the same time as digital broadcast data received from this point is recorded in the segment 1. When reproduction of digital broadcast data stored in the segment 2 is completed, digital broadcast data stored in the segment 1 is reproduced and displayed.

In accordance to one or more embodiments, when either one of the first region 1110 or the second region 1120 is used for a recording region, the other region is used for a reproduction region. When a file is reproduced, the first region 1110 and the second region 1120 are used for recording and reproduction respectively.

The recordable region of the storage medium for a time shift may be set to a fixed size in advance in accordance with one embodiment. Alternatively, the controller can set the recordable region adaptively and variably depending on a current remaking capacity of the storage medium. Preferably, a fixed maximum size is set and the recordable region of the storage medium may be set adaptively and variably depending on a current remaining capacity of the storage medium as described above.

In the above-described embodiments, the controller determines information regarding a position of a region of the storage that is recordable for a time shift operation. For example, when a semiconductor memory is used, a starting position and an end position of a recordable region can be known, and a starting position and an end position of a recorded region with respect to the recordable region can be known by using a memory pointer. Also, when reproduction is performed, a current reproduction position can be known, and when recording is performed, a current recording position can be known.

Figure 15:
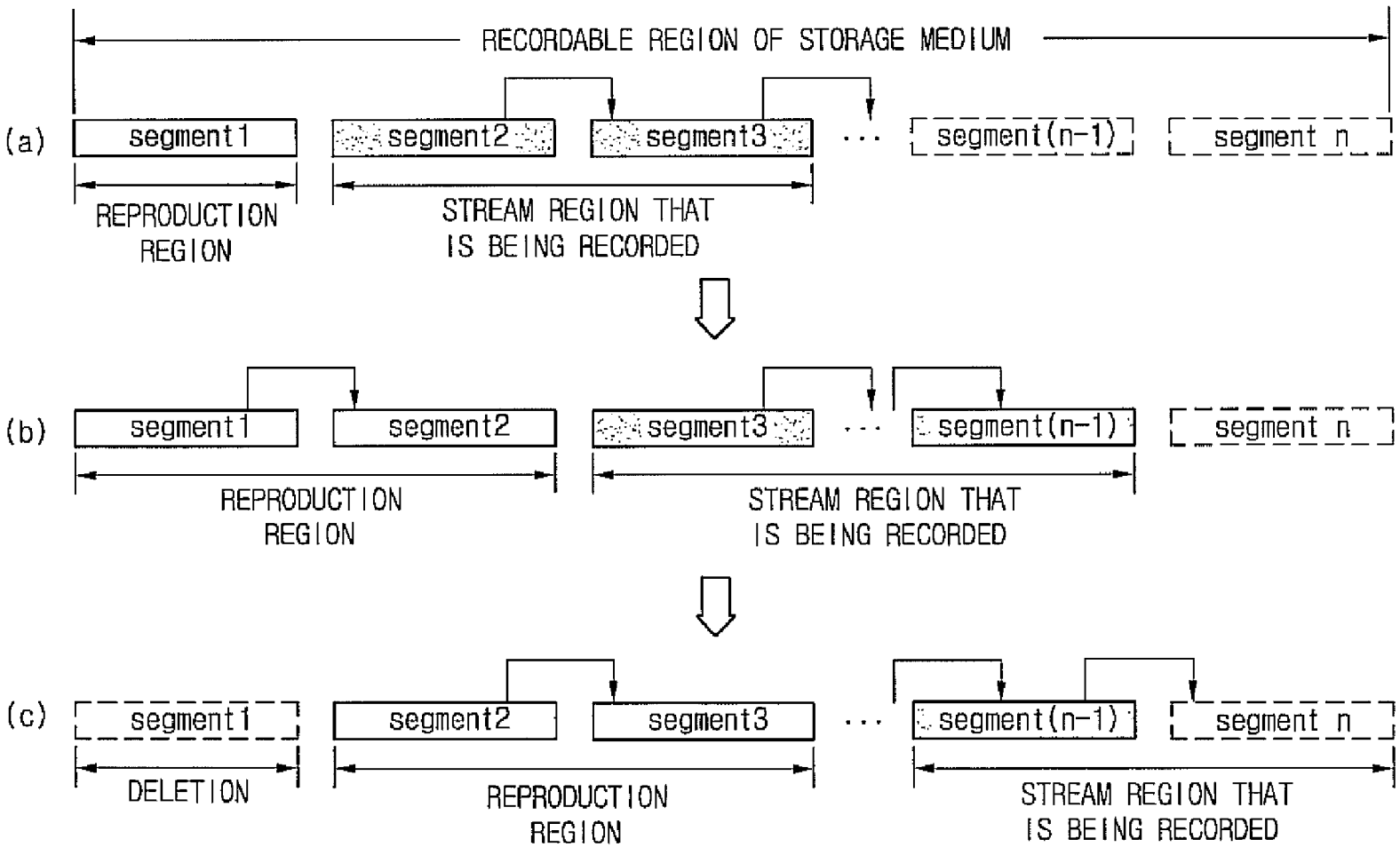
FIG. 15 illustrates a multi-segment mode for using a storage space when digital broadcast content is reproduced in accordance with one embodiment.

When previously stored broadcast data is recorded over at least two regions (i.e., over more than two segments), a multi region mode is activated. The multi region mode may be understood as a multi segment mode. FIG. 15 illustrates digital broadcast data that are recorded over more than two segments. When a reproduction request is made for more than the two segments, a corresponding broadcast data file is reproduced for more than the two segments. Preferably, recording of broadcast data received from this reproduction point is performed. A time shift function for is realized using the multi segment mode as described above, and time shift recording/reproduction can be performed without a file opening/closing operation during the reproducing.

Figure 16:
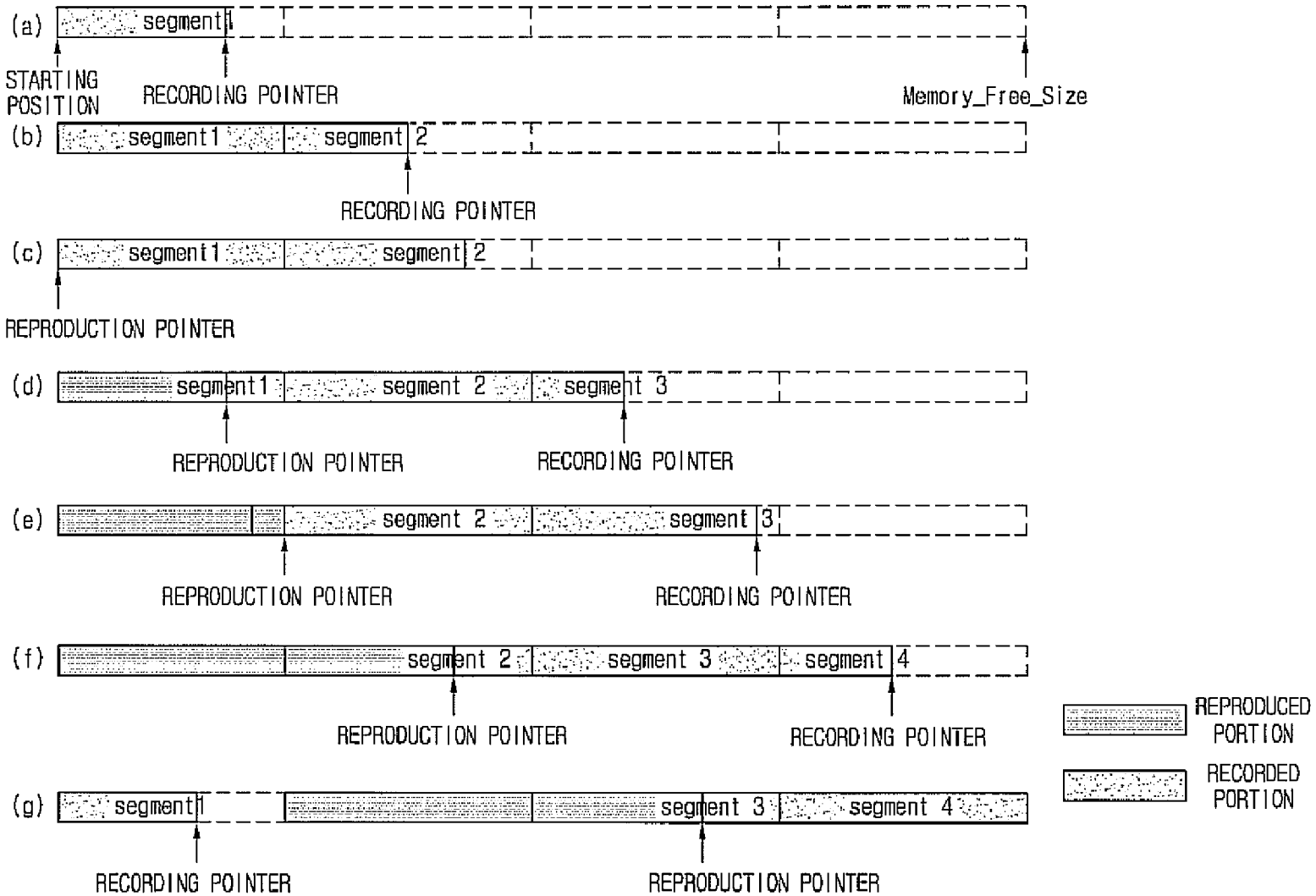
FIG. 16 illustrates a multi-segment mode in a storage space during reproduction of digital broadcast content in accordance with one embodiment.

FIG. 16 illustrates a method of using a storage space when a multi segment mode is performed in accordance with one embodiment. A size of the storage space may be freely set (memory_size_free) as described above. FIG. 16(*a*) illustrates how recording starts from a first region (segment 1) according to a time shift recording request, and a recording pointer (write pointer) indicates a current position of a storage space. FIG. 16(*b*) illustrates how recording is performed up to a second region (segment 2), and a recording pointer indicates a current position of a storage space in the segment 2. FIG. 16(*c*) illustrates how reproduction starts from the segment 1 according to a time shift reproduction request, and a reproduction pointer indicates that the reproduction starts from the beginning of the segment 1.

FIG. 16(*d*) illustrates how reproduction of the segment 1 is performed according to a time shift reproduction request, and the recording pointer illustrates that broadcast data are stored over a third region (segment 3). FIG. 16(*e*) illustrates that a reproduction pointer indicates reproduction of the segment 1 is completed and the segment 2 is being reproduced, and the recording pointer progresses even further and approaches an end of the segment 3. FIG. 16(F) illustrates that the reproduction pointer indicates reproduction of a portion close to an end of the segment 2 and the recording pointer progresses even further and approaches a segment 4. FIG. 16(*g*) illustrates that the reproduction pointer is indicating reproduction of a portion close to an end of the segment 3 is performed, and the recording pointer comes back to the beginning of the segment 1 since a recordable region is used up, and recording is continuously performed from the beginning of the segment 1.

As described above, digital broadcast is stored automatically, by a user's request or by a setting if necessary while the digital broadcast is viewed. When a reproduction and display request is made, the previously stored broadcast data is reproduced and displayed, and simultaneously, broadcast data currently received in real-time are stored constantly. Preferably, the storage and reproduction of broadcast data is performed on the basis of the file switching or multi segment method depending on an amount of previously stored broadcast data, and simultaneously, file deletion is finally performed, so that a use efficiency of a storage space of the storage may be increased.

Since a time shift method in accordance with one or more embodiments is based on recording or reproduction for a short period of time, and opening or closing of a file does not occur during a time shift operation, jitter and delay phenomenon caused by the opening or closing of the file are prevented, so that a limited storage capacity can be efficiently used.

One or more embodiments allow a mobile broadcast receiver based on frequent mobility and a storage medium to efficiently process broadcast data. In other words, one or more embodiments provide a time shift function that allows a user to view broadcast not viewed temporarily during broadcast viewing due to performance of other operations using the mobile broadcast receiver. Also, in accordance with one or more embodiments, image quality reduction or delay is minimized, so that higher quality reproduction and display of broadcast can be achieved.

The embodiments described above are to be considered in all aspects as illustrative only and not restrictive in any manner. It is evident that other alternatives, modifications, variations and embodiments may be apparent to those skilled in the art in light of the foregoing description. Thus, other exemplary embodiments, system architectures, platforms, and implementations that can support various aspects of the invention may be utilized without departing from the essential characteristics described herein.

For example, while processors, controllers and other circuits, are described in terms of specific logical/functional circuitry relationships, one skilled in the art will appreciate that such may be implemented in a variety of ways, such as appropriately configured and programmed processors, ASICs (application specific integrated circuits), and DSPs (digital signal processors). These and various other adaptations, alternatives, modifications, variations and combinations of features of the embodiments disclosed are within the scope of the invention. The invention is defined by the claims and their full scope of equivalents.

What is claimed is:

1. A method of reproducing broadcast content received by a mobile terminal, the method comprising:

reproducing the broadcast content received in real-time at approximately a constant first reproduction rate;

receiving, in response to a detection of a first event, a timeshift recording request to delay reproduction of the broadcast content;

discontinuing, in response to receiving the timeshift recording request, the reproduction of the broadcast content and storing, in a first region of a storage medium, first broadcast content received between a time when the timeshift recording request is received and a time when a timeshift reproduction request is received;

reproducing, in response to receiving the timeshift reproduction request, the first broadcast content stored in the first region of the storage medium at a constant second reproduction rate that is approximately equal to the constant first reproduction rate;

storing, in a second region of the storage medium, second broadcast content received after the time when the timeshift reproduction request is received and while the first broadcast content continues to be reproduced at the constant second approximately the constant first reproduction rate;

deleting the first broadcast content from the first region of the storage medium after the first broadcast content is reproduced while maintaining the second broadcast content in the second region of the storage medium;

reproducing the second broadcast content after the first broadcast content is reproduced; and no longer storing the second broadcast content stored in the second region of the storage medium in response to a determination determining that a predetermined amount of the second broadcast content is deleted from the second region of the storage medium;

wherein the timeshift reproduction request is received in response to detection of a second event.

2. The method of claim 1, wherein the second broadcast content is reproduced after the first broadcast content is deleted from the first region of the storage medium.

3. The method of claim 1, wherein the first event occurs in response to a user interacting with an interface unit of the mobile terminal.

4. The method of claim 1, wherein the first event occurs in response to the mobile terminal receiving an incoming call.

5. The method of claim 1, wherein the first event occurs in response to the mobile terminal initiating an outgoing call.

6. The method of claim 1, wherein the first event is a communication related event directed to the mobile terminal.

7. The method of claim 1, wherein the second event occurs in response to the mobile terminal ending a phone call.

8. The method of claim 1, wherein the second event occurs in response to a user interacting with an interface unit of the mobile terminal.

9. A method of reproducing broadcast content received by a mobile terminal, the method comprising:

receiving, in response to detection of a first event, a first request to delay reproduction of the broadcast content in real-time, wherein the broadcast content is reproduced at a first reproduction rate;

storing, in response to receiving the first request, first broadcast content received between a time when the first request is received and a time when a second request to reproduce the first broadcast content is received, wherein the first broadcast content is stored in a first region of a storage medium;

reproducing, in response to receiving the second request, the first broadcast content stored in the first region of the storage medium at a second reproduction rate that is approximately equal to the first reproduction rate; and storing, in a second region of the storage medium, second broadcast content received after the time when the second request is received, until the first broadcast content stored in the storage medium has been entirely reproduced at the second same first reproduction rate;

deleting the first broadcast content from the first region of the storage medium after the first broadcast content is reproduced while maintaining the second broadcast content in the second region of the storage medium; and no longer storing the second broadcast content stored in the second region of the storage medium in response to a determination determining that a predetermined amount of the second broadcast content is deleted from the second region of the storage medium;

wherein the second request is received in response to detection of a second event.

10. The method of claim 9, wherein the first broadcast content stored in the first region of the storage medium is reproduced simultaneously as the second broadcast content is stored in the second region of the storage medium.

11. The method of claim 9, further comprising reproducing the second broadcast content after the first broadcast content is reproduced.

12. The method of claim 9, wherein the second broadcast content is received in real-time and is not reproduced in real-time until the first broadcast content stored in the first region of the storage medium has been entirely reproduced.

13. The method of claim 9, further comprising reproducing the second broadcast content stored in the second region of the storage medium after a predetermined amount of the first broadcast content is deleted from the first region of the storage medium.

14. The method of claim 9, further comprising reproducing the second broadcast content stored in the second region of the storage medium after the first broadcast content is deleted from the first region of the storage medium.

15. The method of claim 14, further comprising deleting the second broadcast content from the second region of the storage medium after the second broadcast content is reproduced.

16. The method of claim 9, further comprising reproducing third broadcast content received by the mobile terminal in real-time after no longer storing the second broadcast content.

17. A mobile communication terminal comprising:

a receiver for receiving broadcast content over a first broadcast channel; and a controller for controlling reproduction of the broadcast content at a first reproduction rate via a display and speaker of the mobile terminal, wherein, in response to detection of detecting a first event, the controller receives a first request to delay reproduction of the broadcast content received in real-time, wherein, in response to receiving the first request, the controller stores, in a first region of a storage medium, first broadcast content received between a time 'T1' at which the first request is received and a time 'T2' at which of receiving a second request to reproduce the first broadcast content is received, wherein, in response to receiving the second request, the controller reproduces the first broadcast content at a second reproduction rate that is approximately equal to the first reproduction rate, wherein the controller stores in a second region of the storage medium, second broadcast content received after the time 'T2';

wherein the controller deletes the first broadcast content from the first region of the storage medium after the first broadcast content is reproduced while maintaining the second broadcast content and reproduces the second broadcast content at the second approximately the same first reproduction rate, wherein the controller no longer storing the second broadcast content in the second region of the storage medium in response to a determination determining that a predetermined amount of the second broadcast content is deleted from the second region of the storage medium;

wherein the second request is received in response to detection of a second event.

18. The mobile communication terminal of claim 17, wherein the second broadcast content is reproduced after the first broadcast content is deleted from the storage medium.

19. The mobile communication terminal of claim 17, wherein the first event occurs in response to a user interacting with an interface unit of the mobile terminal.

20. The mobile communication terminal of claim 17, wherein the first event occurs in response to the mobile terminal receiving an incoming call.

21. The mobile communication terminal of claim 17, wherein the first event occurs in response to the mobile terminal initiating an outgoing call.

22. The mobile communication terminal of claim 17, wherein the first event is a communication related event directed to the mobile terminal.

23. The mobile communication terminal of claim 17, wherein the second event occurs in response to the mobile terminal ending a phone call.

24. The mobile communication terminal of claim 17, wherein the second event occurs in response to a user interacting with an interface unit of the mobile terminal.

25. A mobile terminal comprising:

a logic unit for receiving a first request to delay reproduction of broadcast content in response to a detection of a first event, wherein the broadcast content is reproduced in real-time at a first reproduction rate;

a logic unit for storing, in a first region of a storage medium, first broadcast content received between a time when the first request is received and a time when a second request to reproduce the first broadcast content is received, wherein the first broadcast content is stored in response to receiving the first request;

a logic unit for reproducing, in response to receiving the second request, the first broadcast content stored in the first region of the storage medium at a second reproduction rate that is approximately equal to the first reproduction rate;

a logic unit for storing, in a second region of the storage medium, second broadcast content received after the time when the second request is received; and a logic unit for deleting the first broadcast content from the first region of the storage medium after the first broadcast content is reproduced while maintaining the second broadcast content in the second region of the storage medium; and a logic unit for no longer storing the second broadcast content in the second region of the storage medium in response to a determination determining that a predetermined amount of the second broadcast content is deleted from the second region of the storage medium;

wherein the second request is received in response to a detection of a second event.

26. The mobile terminal of claim 25, wherein the first broadcast content stored in the first region of the storage medium is reproduced simultaneously as the second broadcast content is stored in the second region of the storage medium.

27. The mobile terminal of claim 25, further comprising a logic unit for reproducing the second broadcast content after the first broadcast content is reproduced.

28. The mobile terminal of claim 25, wherein the second broadcast content is received in real-time and but is not reproduced until after the first broadcast content has been entirely reproduced.

29. The mobile terminal of claim 25, further comprising a logic unit for reproducing the second broadcast content stored in the second region of the storage medium after a predetermined amount of the first broadcast content is deleted from the storage medium.

30. The mobile terminal of claim 25, further comprising a logic unit for reproducing the second broadcast content stored in the second region of the storage medium, after the first broadcast content is deleted from the first region of the storage medium.

31. The mobile terminal of claim 30, further comprising a logic unit for deleting the second broadcast content from the second region of the storage medium, after the second broadcast content is reproduced.

32. The mobile terminal of claim 25, further comprising a logic unit for reproducing third broadcast content received by the mobile terminal in real-time after no longer discontinuing storing the second broadcast content.

33. A method of reproducing broadcast content received by a mobile terminal, the method comprising:

reproducing the broadcast content received in real-time at a predetermined reproduction rate;

receiving, in response to a detection of a first event, a timeshift recording request to delay reproduction of the broadcast content;

no longer reproducing, in response to receiving the timeshift recording request, the broadcast content and storing, in a first recordable region of a storage medium, first broadcast content received between a time when the timeshift recording request is received and a time when a timeshift reproduction request is received;

reproducing, in response to receiving the timeshift reproduction request, the first broadcast content stored in the first recordable region of the storage medium at the predetermined reproduction rate;

storing, in a second recordable region of the storage medium, second broadcast content received after the time when the timeshift reproduction request is received while the first broadcast content continues to be reproduced at the predetermined reproduction rate;

deleting the first broadcast content from the first recordable region of the storage medium after the first broadcast content is reproduced while maintaining the second broadcast content in the second recordable region of the storage medium;

reproducing the second broadcast content after the first broadcast content is reproduced at the predetermined reproduction reproductions rate; and no longer storing the second broadcast content in the second region of the storage medium in response to a determination determining that a predetermined amount of the second broadcast content is deleted from the second region of the storage medium;

wherein sizes of the first and the second recordable regions of the storage medium are set adaptively based on a remaining storage capacity of the storage medium, and wherein the timeshift reproduction request is received in response to detection of a second event.

* * * * *